United States Patent [19]

Rilett

[11] 4,224,799

[45] Sep. 30, 1980

[54] GAS-OPERATED MOTOR SYSTEMS

[76] Inventor: John W. Rilett, 18 Links View, Stratton, Cirencester, Gloucestershire, England

[21] Appl. No.: 925,398

[22] Filed: Jul. 17, 1978

[30] Foreign Application Priority Data

Jul. 16, 1977 [GB] United Kingdom ..... 29987/77

[51] Int. Cl.[3] ..... F01K 25/10

[52] U.S. Cl. ..... 60/671; 60/685

[58] Field of Search ..... 60/651, 671, 685, 650, 60/682

[56] References Cited

U.S. PATENT DOCUMENTS

| | | | |
|---|---|---|---|
| 3,531,933 | 10/1970 | Baldwin | 60/671 X |
| 3,842,333 | 10/1974 | Boese | 60/671 X |
| 3,987,633 | 10/1976 | Ford, Jr. | 60/671 |
| 4,092,830 | 6/1978 | Rilett | 60/671 |

FOREIGN PATENT DOCUMENTS

| | | | |
|---|---|---|---|
| 2326596 | 4/1977 | France | 60/651 |
| 155220 | 6/1921 | United Kingdom | 60/685 |

*Primary Examiner*—Allen M. Ostrager
*Attorney, Agent, or Firm*—Dennison, Dennison, Meserole & Pollack

[57] ABSTRACT

A gas-operated motor system of the stored energy type—as disclosed in U.S. Pat. No. 4,092,830—in which the gas exhausted from the motor is ducted to a chamber during operation of the motor and thereafter compressed back into the gas reservoir vessel. Recompression may be achieved e.g. by providing the exhaust gas chamber with a movable piston, or by running the motor in the reverse mode as a compressor.

10 Claims, 3 Drawing Figures

GAS-OPERATED MOTOR SYSTEMS

FIELD OF THE INVENTION

The present invention relates to gas-operated motor systems wherein the motor is driven by the pressure of a non-combusting gas, for example carbondioxide. More particularly the invention is concerned with stored energy gas-operated motor systems which term, for the purpose of this specification, is defined as a system comprising a gas-operated motor, a reservoir vessel adapted to contain gas or a gas/liquefied gas mixture under pressure, a passage for the supply of gas from said vessel to the working chamber or chambers of the motor, and a container holding or capable of being charged with a buffer substance in heat conductive relationship with said vessel and/or passage thereby to provide heat to the gas prior to its expansion in the motor. Such systems are described in my U.S. Pat. No. 4,092,830, to which reference is directed for a full discussion of the merits of employing buffer substances in conjunction with the gas supply means of such systems.

BACKGROUND AND SUMMARY OF THE INVENTION

The references mentioned above describe stored energy gas-operated motor systems in which the working fluid, after passing through the motor, is exhausted to atmosphere. Such practice is satisfactory in applications where the gas usage is low but there are other applications, such as in the larger control-line and radio-controlled model aircraft, lawn mowers, fork-lift trucks and so on up to significantly higher powers and energy capacities, in which it becomes economically desirable to re-use the working fluid.

The present invention accordingly provides a gas-operated stored energy motor system including means for ducting the gas exhausted from the motor to a chamber during operation of the motor, and means for recompressing the exhaust gas from said chamber into the reservoir vessel.

The chamber to which the exhaust gas is ducted may be, for example, defined by a cylinder provided with a movable piston which can be driven by separate motor means to recompress the exhaust gas from the chamber into the reservoir vessel. In another preferred embodiment, however, the gas-operated motor is itself additionally adapted to be driven, by separate motor means, in the reverse mode—i.e. as a compressor—to return the exhaust gas to the reservoir vessel.

The invention will now be more particularly described with reference to the accompanying drawings in terms of its application to use in a lawn mower. This is but one example of the many suitable uses to which the invention may be put, and is for the purpose of illustration only.

BRIEF DESCRIPTION OF THE DRAWINGS

Like parts are denoted by like reference numerals throughout the drawings.

DETAILED DESCRIPTION OF THE DRAWINGS

Throughout the following description, all pressures mentioned are gauge pressures.

Figure 1:
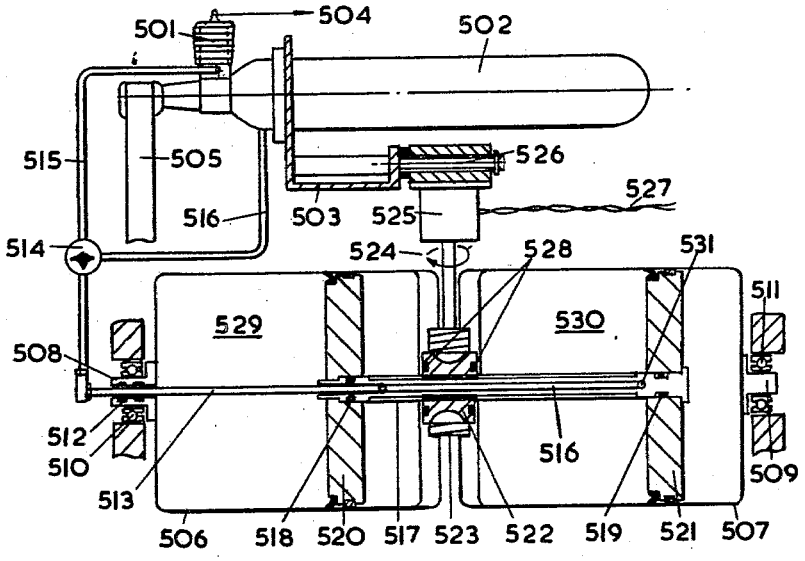
FIG. 1 shows schematically, part in elevation and part in cross section, one embodiment of the invention as applied to a lawn mower.

Referring to FIG. 1, reference numeral 501 denotes a gas-operated motor of typical power 100 to 200 watts and reference numeral 502 denotes a power capsule incorporating a buffered gas supply reservoir of capacity typically 500 to a 1000 grams (in the case of $CO_2$ as the working fluid) mounted on a frame member 503 of the lawn mower.

A toothed belt 505 or other suitable transmission device couples the motor drive shaft to two hollow rollers 506 and 507 and also if necessary to the rotary, cylindrical or other cutter of the lawn mower (not shown). The rollers are provided with journals 508 and 509 supported in bearings 510 and 511 in the mower frame. The lefthand journal 508 (as viewed in the Figure) has a central hole sealed by O-rings 512 or other suitable sealing devices onto a fixed torque tube 513 which is connected via a valve 514 and pipe 515 to the exhaust gas outlet of the motor 501. The torque tube 513 fits inside (but not in a gas-tight manner) the central bore 516 of a lead screw 517 which is provided with an internal groove engaging with an asymmetric protuberance (not shown) on the torque tube so as to prevent rotation of the lead screw whilst permitting axial movement of the screw relative to the torque tube. The two ends of the lead screw are provided with sealed journals 518 and 519 carrying pistons 520 and 521 which may rotate relative to the lead screw but are prevented from axial movement relative thereto. The lead screw passes through an internally threaded member 522 which constitutes also a worm wheel engagable with a worm 523 which can be driven in the direction of the arrow 524 by an electric motor 525 (which may have a power of typically 10 to 30 watts) supplied through mains leads 527 which are disconnected when the lawn mower is in use. The electric motor 525 is rotatably supported for instance on a spindle 526 and has provision (not shown) whereby it may be swung in or out so as to engage or disengage the worm from the wheel. The wheel 522 is provided with sealing rings 528 which seal its two faces against the adjacent surfaces of the rollers 506 and 507 so as to allow slightly resisted relative rotation of the two rollers (to facilitate turning corners when mowing) whilst preventing gas loss therefrom.

During lawn mowing the gas which exhausts from motor 501 is ducted through pipe 515, valve 514 and torque tube 513 into the bore 516 of the lead screw. From the bore 516 the gas passes into the two sealed chambers 529 and 530 which are defined within the rollers 506 and 507 to the left (as viewed) of the pistons 520 and 521 respectively. Gas flow to chamber 529 is afforded by the clearance which exists between the exterior of the torque tube and the bore 516 at its left-hand end, and gas flow to chamber 530 is afforded by a crosshole 531 provided at the opposite end of the bore. As the rollers are rotatably driven by the motor the friction fit between the rollers and wheel 522 likewise causes the latter to rotate, in so doing the threaded connection between member 522 and the non-rotating lead screw 517 being effective to drive the lead screw and pistons 520/521 slowly to the right. The movement of the pistons gradually increases the volumes of the chambers 529 and 530 so as to maintain an approximately constant exhaust pressure in the region of 10 to 20 atmospheres. The power capsule 502 is buffered to give a motor supply gas pressure in the region of 40 to 60 atmospheres, so a motor of expansion ratio of only 3:1 or thereabouts will suffice, allowing the motor to be small.

After lawn mowing the worm 523 and wheel 522 are engaged, the electric motor 525 is connected and switched on, and the valve 514 switched to direct the gas flow from the rollers to the power capsule 502 via the branch pipe 516. The worm is effective to rotate the wheel in the direction opposite to that which pertains during lawn mowing, whereupon the lead screw and pistons 520/521 move slowly leftward, recompressing the gas from the chambers 529 and 530 into the power capsule where it condenses (if $CO_2$) with help from the power capsule's buffer (now frozen) and from natural heat loss to the environment. The power capsule is safety-valved at perhaps 2000 psi (with a burst pressure of perhaps 5000 psi) which will permit recompression of the $CO_2$ at temperatures as high as 100° C. or more, though natural heat loss, and design—by use of a buffer having a freezing point of typically 20° C.—should limit this temperature to a much lower figure and permit ultimate condensation of the $CO_2$ when below its critical temperature of 31° C. Recharging of the power capsule in this way may take one to two hours with the small electric motor described but, with a more powerful electric motor and suitable design, this recharge time may be reduced considerably.

Figure 2:
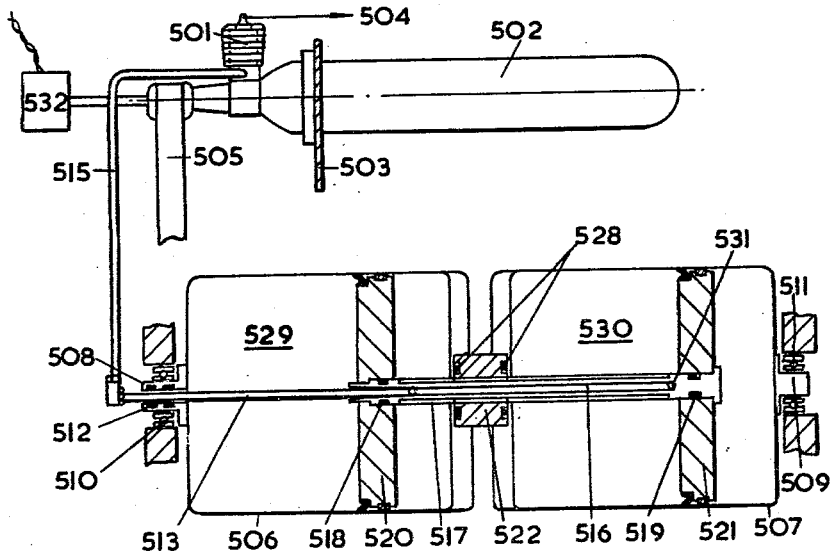
FIGS. 2 and 3 are similar views of two other embodiments.

Turning now to FIG. 2 this shows an alternative embodiment which dispenses with the need to provide the worm 523 and a mechanism for latching it in and out of engagement with the member 522, the external toothform on member 522, valve 514 and branch pipe 516. Instead, the electric motor for use in recharging is sited at 523 and arranged to drive the motor 501 in the reverse mode so that it acts as a compressor to return exhaust gas from chambers 529/530 back to the power capsule 502. By this means not only is a simplification in the number of required components obtained, but also since the work of compressing the gas back into the power capsule is taken over from the pistons 520 and 521 by the motor/compressor 501, the rollers 506 and 507 become safer and easier to manufacture as they then require to sustain a pressure of only 10 to 20 atmospheres. Whilst being driven backwards as a compressor, the "motor " will of course in addition drive the pistons 520 and 521 leftwards, encouraging the return flow of the working fluid and maintaining the inlet pressure to the compressor at a sensibly constant level. Furthermore in the event of gas leakage past the piston of the compressor, the pistons 520 and 521 will automatically restore the gas feed into the compressor. While the motor is operating to recompress the exhaust gas into the power capsule the buffer substance performs the valuable function of absorbing heat from the gas in addition to the buffer substance(s) in the power capsule.

Figure 3:
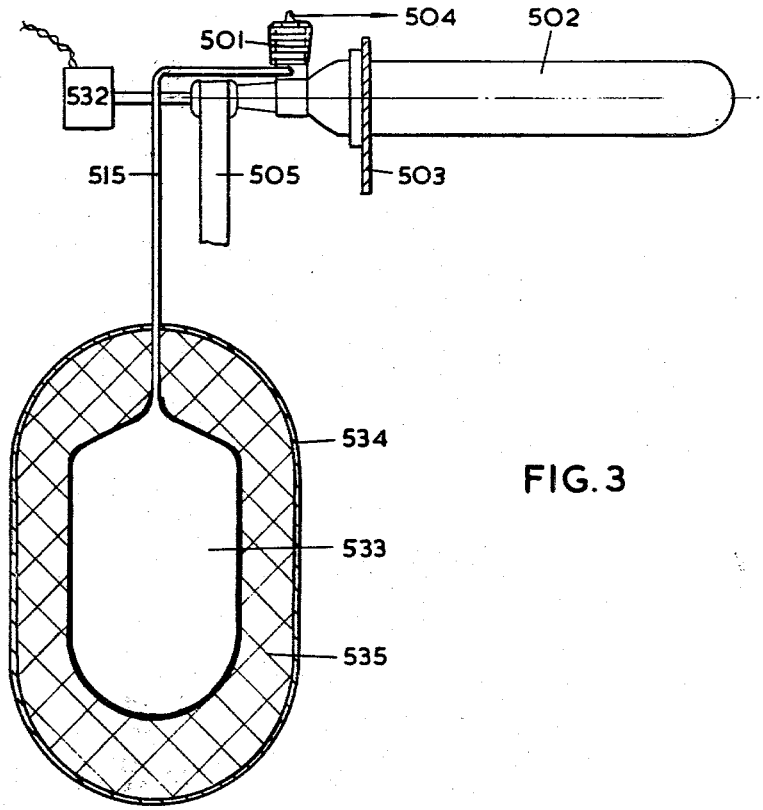

A further simplication of the arrangement shown in FIG. 2, whereby the pistons 520 and 521, lead screw 517, member 522, torque tube 513 and the several seals associated with these parts may be dispensed with, will now be described with reference to FIG. 3. In this embodiment, the exhaust pipe 515 leads to a sealed bag 533 designed to be able to swell (being made of an elastomeric material, or as a bellows preferably with a return spring or other cushioning device to squeeze the bellows, or in other known ways known generally as 'pneumatic accumulator') as it receives exhaust gas from the motor 501, and to squeeze the gas to flow in the reverse direction back to the motor when the latter is operating as a compressor. Such an arrangement is particularly suitable if the working fluid is a halocarbon such as one of the FREONs (registered trademark), or a similar substance operating at lower pressures than a $CO_2$ working fluid (e.g. at 0–10 atmospheres) and which may partially condense in the sealed bag.

The sealed bag may if appropriate be contained within an outer chamber 534 and the space between the sealed bag and the outer chamber may be advantage be partially or completely filled with an insulating material 535 such as polyurethane foam which is also compressible as the bag swells and which may also advantageously be particulate, for instance being in the form of many small soft polyurethane foam rubber balls. The purpose of such compressible insulation is to prevent heat flow into the exhaust gas (which may be at a temperature typically of 0 to −30° C. depending on the choice of working fluid) from the surroundings and so to reduce the work done in subsequent compression and to reduce the temperature of the power capsule during that compression. Alternatively the space between the sealed bag and the outer chamber (or between the outer chamber and a further jacket surrounding it) may be evacuated and possibly mirror-surfaced in the known manner of vacuum insulated vessels, again in order to prevent heat flow from the surroundings into the gas.

I claim:

1. A fluid pressure operated motor system comprising: a fluid pressure operated motor; a reservoir vessel adapted to contain pressurized fluid; a passage for the supply of pressure fluid from said vessel to a working chamber of the motor; a container holding a buffer substance in heat exchange relationship with said pressure fluid; an exhaust chamber arranged to receive the pressure fluid exhausted from the motor during operation thereof; and means for recompressing the exhaust from said exhaust chamber back into the reservoir vessel when said motor is not performing a work output function.

2. A system according to claim 1 wherein said working chamber is defined by a cylinder provided with a movable piston, and comprising further motor means for driving said piston to recompress the exhaust from the working chamber into the reservoir vessel subsequent to operation of the fluid pressure operated motor.

3. A system according to claim 2 wherein said piston is arranged to be driven by the fluid pressure operated motor to increase the volume of the exhaust chamber available to receive exhaust during operation of the fluid pressure operated motor.

4. A system according to claim 1 wherein the fluid pressure operated motor is further adapted to be driven as a compressor; and comprises separate motor means for driving the fluid pressure operated motor as a compressor to recompress the exhaust from said exhaust chamber back into the reservoir vessel subsequent to operation of the fluid pressure operated motor as a motor.

5. A system according to claim 4 wherein said exhaust chamber is defined by a cylinder provided with a movable piston and the piston is arranged to be driven to decrease the volume of the chamber available to retain exhaust during operation of the fluid pressure operated motor as a compressor.

6. A system according to claim 4 wherein said exhaust chamber is expansible against a resilient bias under the pressure of exhaust fed to it from the fluid pressure operated motor.

7. A system according to claim 1 wherein said exhaust chamber is thermally insulated from it surroundings.

8. A system according to claim 1 wherein it is arranged that the exhaust gas partially condenses in said exhaust chamber.

9. A system according to claim 1 wherein said buffer substance aborbs heat from the exhaust gas during said recompression thereof.

10. A system according to claim 4 comprising a container charged with a buffer substance in heat exchange relationship with the working chamber of the motor and to heat the pressure fluid during expansion in the motor and to absorb heat from the exhaust during said recompression thereof.

* * * * *